United States Patent [19]

Ohta et al.

[11] Patent Number: 4,732,545

[45] Date of Patent: Mar. 22, 1988

[54] APPARATUS FOR LUBRICATING WOBBLE PLATE BEARINGS OF A WOBBLE PLATE TYPE COMPRESSOR

[75] Inventors: Masaki Ohta; Kenji Takenaka; Hiroaki Kayukawa; Akihiko Hyodo, all of Kariya, Japan

[73] Assignee: Kabushiki Kaisha Toyoda Jidoshokki Seisakusho, Aichi, Japan

[21] Appl. No.: 928,921

[22] Filed: Nov. 7, 1986

[30] Foreign Application Priority Data

Nov. 8, 1985 [JP] Japan ..... 60-172692[U]

[51] Int. Cl.[4] ..... F04B 1/28

[52] U.S. Cl. ..... 417/222; 417/269; 184/6.17

[58] Field of Search ..... 417/269; 184/6.17, 13.1

[56] References Cited

U.S. PATENT DOCUMENTS

| | | | |
|---|---|---|---|
| 1,428,751 | 9/1922 | Burke | 184/13.1 |
| 1,936,101 | 11/1933 | Baits et al. | 184/13.1 |
| 3,067,694 | 12/1962 | Fawcher | 417/269 |
| 3,085,514 | 4/1963 | Buduch | 417/269 |
| 3,945,765 | 3/1976 | Toyoda | 184/6.17 |
| 4,444,549 | 4/1984 | Takahashi | 417/269 |
| 4,480,964 | 11/1984 | Skinner | 417/222 |

*Primary Examiner*—William L. Freeh

*Attorney, Agent, or Firm*—Burgess, Ryan and Wayne

[57] ABSTRACT

A variable capacity wobble plate type compressor with a lubricator for oil-lubricating wobble plate bearings in a crankcase interior, which has an oil dam formed in an entrance of the central bore of a drive plate rotatably mounted on a compressor drive shaft for catching and preserving a lubricating oil scattered by a non-rotary wobble plate during wobbling in the crankcase interior and an oil supply conduit for supplying the preserved oil in the oil dam to the thrust and radial bearings by which the wobble plate is supported on the drive plate.

4 Claims, 3 Drawing Figures

APPARATUS FOR LUBRICATING WOBBLE PLATE BEARINGS OF A WOBBLE PLATE TYPE COMPRESSOR

BACKGROUND OF THE INVENTION

1. Field of the Invention

The present invention relates to a variable displacement wobble plate type compressor. More particularly, the present invention relates to an apparatus for lubricating wobble plate bearings of the wobble plate type compressor.

2. Description of the Related Art

A multi-piston refrigerant compressor for use in a vehicle air-conditioning circuit is known. In such a compressor, lubricating oil is contained in the refrigerant gas for lubricating internal moving elements of the compressor during running thereof. One typical apparatus for lubricating the moving elements of a multi-piston compressor is disclosed in U.S, Pat. No. 4,070,136 to Nakayama et al, in which the internal arrangement for lubricating ball bearings and shoes connecting multi-pistons and a swash plate is provided so as to introduce oil particles suspended in the refrigerant suction gas into a swash plate chamber for rotatably mounting the swash plate therein, whereby the oil particles lubricate the ball bearings and the shoes. The known internal lubricating arrangement, however, is not applicable to a variable capacity wobble plate type compressor, because a direct introduction of the oil suspended suction refrigerant gas into a crankcase for receiving therein a wobble plate mechanism makes it impossible to control the inclination angle of the wobble plate in response to a change in a cooling load of the air-conditioning circuit.

Another typical refrigerant compressor lubrication system is disclosed in U.S. Pat. No. 4,480,964 to Skinner in which oil entrained in the refrigerant is used to lubricate critical bearing surfaces of a variable capacity wobble plate type compressor, by providing the compressor interior with a lubrication-vent path arrangement, i.e., a crank-casesuction vent formed with bleed or vent passages connecting the crankcase to the compressor suction chamber. This U.S. patent also discloses that the centrifugal action at the rotating bearing surfaces can be utilized to constantly maintain a certain amount of oil in the crankcase bottom for further compressor lubrication usage. The lubrication system of U.S. Pat. No. 4,480,964, however, is not provided with a means for preserving the oil in the proximity of the critical bearings surfaces per se arranged between a rotatable drive plate and a non-rotatable wobble plate of the variable capacity wobble plate type compressor, and as a result, lubrication of the bearing surfaces becomes insufficient during the operation of the wobble plate type compressor.

SUMMARY OF THE INVENTION

An object of the present invention is to eliminate the above-mentioned defects encountered by the conventional compressor lubrication system of a wobble plate type compressor.

Another object of the present invention is to provide an apparatus for forcibly lubricating wobble plate bearings of a variable capacity wobble plate type compressor due to the provision of an internal construction for preserving oil in the proximity of the wobble plate bearings.

In accordance with the present invention, there is provided a variable capacity wobble plate type compressor including a compressor head having therein a suction chamber for a refrigerant to be compressed and a discharge chamber for a compressed refrigerant, a cylinder block having therein a plurality of cylinder bores in which reciprocatory pistons are disposed so as draw the refrigerant from the suction chamber, and to then discharge the refrigerant after compression to the discharge chamber, a crankcase connected to the cylinder block and receiving therein an axial drive shaft and an assembly of a rotatable drive plate mounted on the drive shaft and a non-rotary wobble plate supported on the drive plate, via radial and thrust bearings so as to cause a compressing motion of the reciprocatory pistons, a lubricating means comprising an oil dam means arranged in the proximity of the radial and thrust bearings for preserving lubricating oil therein, and an oil supply conduit means extending from the oil dam means to the radial bearing for continuously lubricating the radial and thrust bearings, a guide means for permitting inclination of the wobble plate from a plane perpendicular to the drive shaft while preventing any rotation of the wobble plate about the drive shaft, and a control valve for controlling the angle of inclination of the wobble plate in accordance with a refrigerating load. The oil dam means defines an oil reservoir to catch and preserve the lubricating oil when the oil in the crankcase bottom is splashed on the wobble plate during running of the compressor.

BRIEF DESCRIPTION OF THE DRAWINGS

Other objects, features and advantages of the present invention will be made more apparent from the ensuring description of the embodiment of the present invention with reference to the accompanying drawings, wherein.

DESCRIPTION OF THE PREFERRED EMBODIMENT

Figure 1:
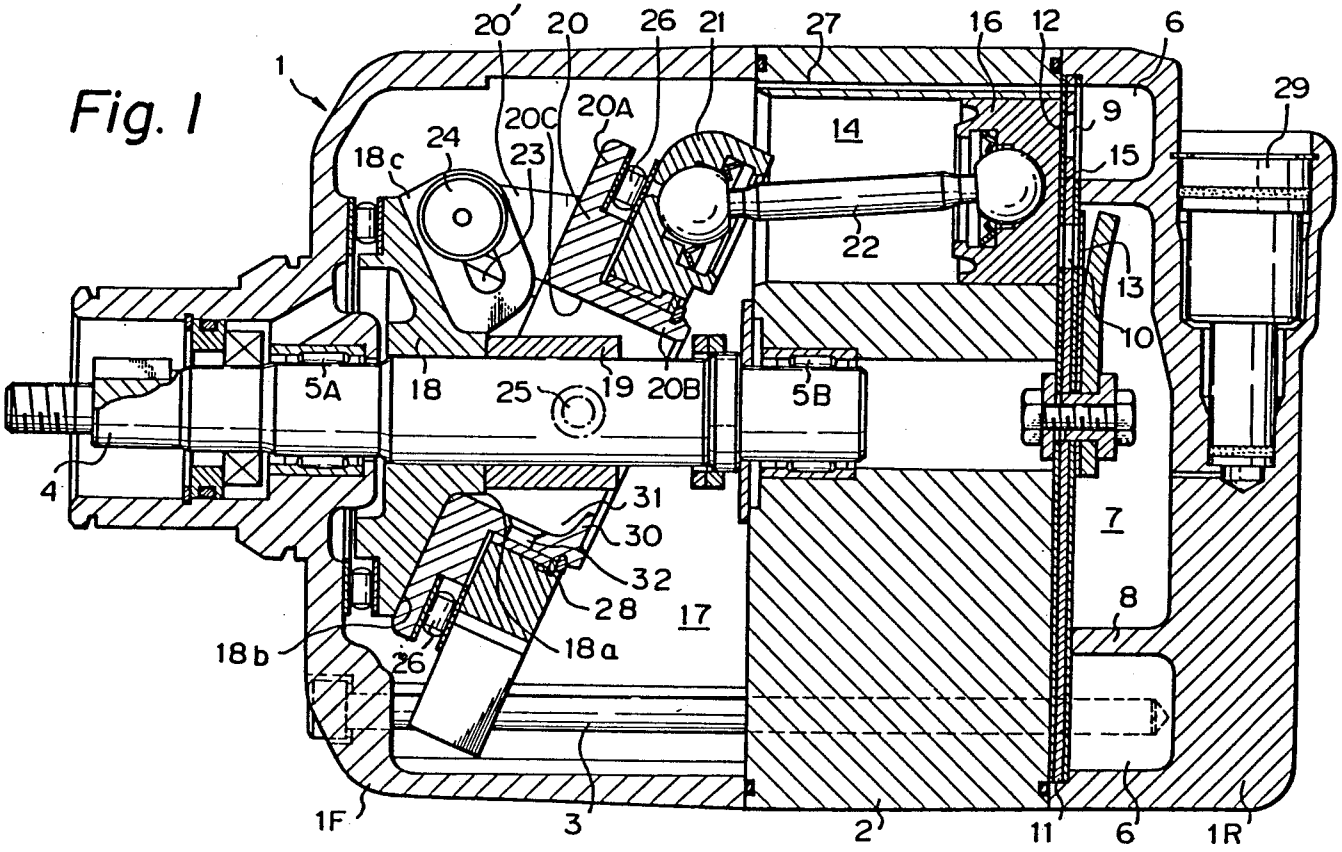
FIG. 1 is a vertical cross-sectional view of a variable capacity wobble plate type compressor with an apparatus for lubricating wobble plate bearings, according to an embodiment of the present invention.

Referring to FIG. 1, a variable capacity wobble type compressor includes a housing 1 forming an outer shell of the compressor. The housing 1 includes a front housing lF, a rear housing lR, and a cylinder block 2, which are combined by a plurality of screw bolts 3 extending through these three elements lF, lR, and 2. That is, the plurality of screw bolts 3 are equiangularly arranged around the central axis of the housing 1, and are inserted from an outer end of the front housing lF, through the cylinder block 2, and into the rear housing lR, and the threaded ends of the screw bolts 3 are threadedly and tightly engaged in the rear housing lR. One of the plurality of screw bolts 3, i.e., the bolt 3 arranged at the bottom portion of the housing 1, is used to prevent rotation of a wobble plate 21 and to guide the wobbling motion of the wobble plate 21, as described later. The front housing lF is connected to one end face of the cylinder block 2, and at the center thereof, has a bearing portion 5A for rotatably supporting a drive shaft 4 which outwardly extends beyond the outermost end of the housing 1 so as to be connectable to a rotational drive source (not shown). The rear housing lR forming a compressor head is connected to the other end face of the cylinder block 2, and has a suction chamber 6 and a discharge chamber 7 arranged concentrically and separated from one another by a section wall 8. The discharge chamber 7 is formed at the central portion of the rear housing 1R, and the suction chamber 6 is provided so as to surround the discharge chamber 7. The suction and discharge chambers 6 and 7 of the rear housing 1R are respectively communicated with respective compression chambers 15 formed by a plurality of cylinder bores 14 of the cylinder block 2, via suction ports 9 and discharge ports 10 formed in a valve plate 11 which is intervened between the rear housing 1R and the end of the cylinder block 2. Pistons 16 are axially slidably fitted in the cylinder bores 14 so as to carry out reciprocal compression and suction motions in the cylinder bores 14. When the pistons 16 are in the suction stroke thereof, suction valves 12 are moved from the closing position thereof to the open position, thus opening the suction ports 9. Discharge valves 13 closing the discharge ports 10 are arranged in the discharge chamber 7 and are opened by the compression motion of the pistons 16. The cylinder block 2 usually has a cylindrical shape, and at the central portion thereof, has a bearing portion 5B coaxial with the above-mentioned bearing portion 5A of the front housing 1F, for supporting the drive shaft 4. The cylinder block 2 is formed with the above-mentioned plurality of cylinder bores 14 extending in parallel with the axis of the drive shaft 4 and arranged to be equiangularly spaced apart from one another on a circle about the axis of the drive shaft 4. Each of the cylinder bores 14 is slidably fitted with a reciprocatory piston 16 having one end, i.e., the right end in FIG. 1, working as a compression face defining the above-mentioned compression chamber 15 in the rear area of each cylinder bore 14 alternately communicatable with the suction chamber 6 and the discharge chamber 7 in response to the reciprocal suction and compression motions of the piston 16.

The front housing 1F is provided as a crankcase for receiving in the interior 17 thereof a later-described wobble plate assembly mounted on the drive shaft 4 extending through the crankcase interior 17. The crankcase interior 17 is always fluidly connected to the plurality of cylinder bores 14.

The wobble plate assembly includes a lug plate 18 mounted on the drive shaft 4 so as to be rotatable with the drive shaft 4. The lug plate 18 is centrally formed with an annular end face 18*a* against which a later-described sleeve element 19 slidably mounted on the drive shaft 4 is abutted. The lug plate 18 is also formed with an inclined face 18*b* against which a drive plate 20 is abutted, and a lug 18*c* projecting in the crankcase interior 17 and arranged at a position spaced 180 degrees apart from the inclined face 18*b*. The drive plate 20 in the form of a generally annular member surrounding the drive shaft 4 is pivotally mounted on the lug 18*c* so as to be capable of changing an angle of inclination thereof with respect to the drive shaft 4. More specifically, the lug 18*c* of the lug plate 18 is formed with an elongated and curving through-hole 23 in which a laterally extending connecting pin 24 is engaged. The connecting pin 24 per se is fixed to a bracket 20′ extending from the drive plate 20 toward the lug 18*c* of the lug plate 18. Thus, the drive plate 20 is permitted to rotate with the lug plate 18, and to smoothly change the inclination angle thereof with respect to the drive shaft 4. The sleeve element 19 slidable on the drive shaft 4 is connected to the drive plate 20 by a pair of lateral connecting pins 25 (see FIG. 2) so that, when the drive plate 20 carries out the wobbling motion about an axis perpendicular to the drive shaft 4, the sleeve element 19 slides on the drive shaft 4.

Figure 2:
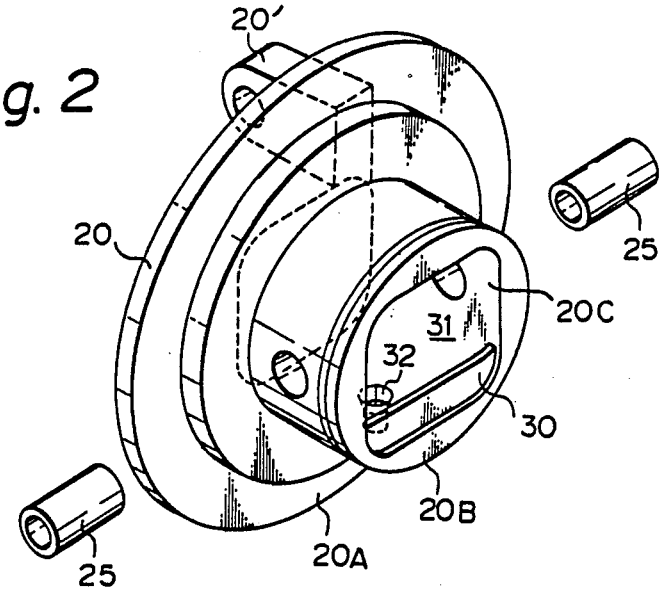
FIG. 2 is an enlarged perspective view of a drive plate for supporting a wobble plate thereon, accommodated in the wobble plate type compressor of FIG. 1.
Figure 3:
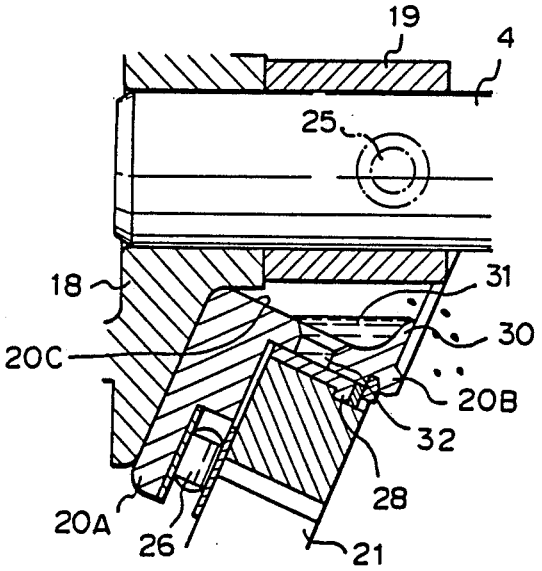
FIG. 3 is a partial cross-sectional view of the lubricating apparatus of FIG. 1, illustrating the lubricating operation thereof.

Referring to FIG. 2 together with FIG. 1, the drive plate 20 includes a large disk portion 20A having the afore-mentioned bracket 20′ on the face confronting the lug plate 18 and a small cylindrical portion 20B extending at a right angle from the center of the large disk portion 20A toward the cylinder block 2. The small cylindrical portion 20B is integral with the large disk portion 20A, and is centrally formed with a quadrilateral bore 20C through which the drive shaft 4 extends. The drive plate 20 supports thereon the afore-mentioned wobble plate 21 via a thrust bearing 26 intervened between the wobble plate 21 and the large disk portion 20A and a radial bearing (journal bearing) 28 intervened between the wobble plate 21 and the small cylindrical portion 20B. The thrust and radial bearings 26 and 28 are elements that must be always kept in a lubricated condition during running of the compressor. The wobble plate 21 has a bottom portion engaged with one of the screw bolts 3 via a radially slidable element (not shown), and is prevented from being rotated with the drive plate 20. The wobble plate 21 is, however, permitted to wobble with the drive plate 20 about an axis perpendicular to the axis of the drive shaft 4. The small cylindrical portion 20B of the drive plate 20 has an outermost end thereof in which a radially inwardly raised dam 30 is formed so as to define an oil reservoir 31 in the quadrilateral bore 20C of the drive plate 20. The oil reservoir 31 is provided at the bottom thereof with a radial through-hole 32 formed as an oil supply conduit for permitting a lubricating oil to flow from the oil reservoir 31 toward the above-mentioned radial bearing 28 seated on the small cylindrical portion 20B, as best shown in FIG. 3. The oil reservoir 31 and the radial through-hole 32 constitutes an apparatus for lubricating the wobble plate bearings 26 and 28, according to the present invention.

The wobble plate 21 is a non-rotary annular member mounted on the drive plate 20 so as to surround the drive shaft 4. The wobble plate 21 is connected to respective pistons 16 by means of connecting rods 22 and ball and socket joints, as best shown in FIG. 1. Thus, when the lug plate 18 is rotated by the drive shaft 4 so that the wobbling motion of the drive plate 20 and the wobble plate 21 is caused, the pistons 16 are reciprocated in the cylinder bores 14. That is, compressing and suction motions of the pistons 16 are carried out. At this stage, it should be understood that when the lug 18*c* of the lug plate 18 is rotated to a position in alignment with respective cylinder bores 14, the corresponding one of the pistons 16 comes to the top dead center thereof while compressing a refrigerant gas within the compression chamber 15. FIG. 1 illustrates one of the pistons 16 at the top dead center position. An axial relief passage 27 axially piercing the cylinder block 2 is provided for fluidly connecting the crankcase interior 17 to the suction chamber 6, thereby permitting crankcase pressure to leak into the suction chamber 6. A control valve 29 mounted in the rear housing 1R is provided for controlling the crankcase interior pressure, thereby controlling the inclination angle of the wobble plate 21 in response to a change in a cooling load applied to the air-conditioning circuit in which this wobble plate type compressor is used. Since the control valve 29 per se is not directly related to the subject matter of the present invention, a detailed construction and operation of the control valve 29 is not further described herein. However, a copending U.S. patent application Ser. No. 812,247, now U.S. Pat. No. 4,687,419, discloses a typical example of the crankcase interior pressure control valve accommodated in the wobble plate type compressor.

The operation of the apparatus for lubricating the wobble plate bearings, according to the above-described embodiment, will be described hereinbelow with reference to FIGS. 1 through 3.

When the wobble plate type compressor is connected to a drive source, i.e., a car engine, by a solenoid clutch, the drive shaft 4 is rotated so as to cause the rotating and wobbling motion of the drive plate 20. The rotating and wobbling motion of the drive plate 20 causes the wobbling motion of the non-rotary wobble plate 21 via the thrust and radial bearings 26 and 28 under the guidance of one of the screw bolts 3, which is engaged with the bottom portion of the wobble plate 21. Thus, the pistons 16 are reciprocated in the cylinder bores 14 by the wobble plate 21 via the connecting rods 22. As a result, the refrigerant gas is drawn from the suction chamber 6 into the compression chambers 15 via the suction valves 12, and then subjected to compression by the pistons 16. The compressed refrigerant gas is thereafter discharged from the compression chambers 15 of the cylinder bores 14 into the discharge chamber 7 via the discharge valves 13. The refrigerant gas leaking from the compression chambers 15 into the crankcase interior 17 due to blowby is returned to the suction chamber 6 through the relief passage 27.

During the wobbling motion of the wobble plate 21 in the crankcase interior 17, the oil stored in the bottom of the front housing lF is scattered by the bottom portion of the wobble plate 21. As a result, the crankcase interior 17 is filled with an oil mist and oil particles. A part of the oil mist and particles is then caught by and retained in the oil reservoir 31, as illustrated in FIG. 3. That is, the oil is retained in the proximity of the wobble plate bearings 26 and 28. The oil retained in the oil reservoir 31 is supplied through the oil supply conduit, i.e., the radial through-hole 32, toward the radial bearing 28 seated on the cylindrical portion 20B of the drive plate 20 due to a centrifugal force caused by the rotation of the drive plate 20. The oil thus lubricates the outer circumference of the radial bearing 28 and the journal portion of the wobble plate 21. The oil is then supplied to the thrust bearing 26 by the centrifugal action caused by the rotation of the drive plate 20, to lubricate the bearing 26. The oil then flows on the surface of the large disk portion 20A of the drive plate 20 and is returned to the bottom of the crankcase interior 17. Therefore, the wobble plate bearings 26 and 28 are forcibly lubricated by the lubricating oil in the crankcase interior due to the centrifugal action caused by the rotation of the drive plate during running of the compressor. The oil preservation by the oil reservoir 31 formed by the dam 30 of the drive plate 20 is thus very effective for constant lubrication of the wobble plate bearings. Further, the oil preservation by the apparatus of the present invention can contribute to a prevention of a lowering of the refrigerating function of the air-conditioning circuit which may occur because of venting of the oil from the compressor into the air-conditioning circuit while suspended in the refrigerant gas.

From the foregoing description of the preferred embodiment of the present invention, it will be understood that, according to the present invention, an apparatus for forcibly lubricating the wobble plate bearings is provided.

We claim:

1. A variable capacity wobble type compressor comprising:

a compressor head having therein a suction chamber for a refrigerant to be compressed and a discharge chamber for a compressed refrigerant, a cylinder block having therein a plurality of cylinder bores in which reciprocatory pistons are disposed so as to draw the refrigerant from said suction chamber and then to discharge the refrigerant after compression to said discharge chamber, a crankcase connected to said cylinder block and receiving therein an axial drive shaft having a lug plate mounted thereon to be rotatable with said drive shaft, a rotary drive plate arranged so as to surround said drive shaft and rotate with said drive shaft, said rotary drive plate including a large disc portion engaged, via a bracket thereof, with said lug plate in such a manner that said drive plate is rotated with said lug plate and wobbled with respect to said drive shaft, said rotary drive plate further including a small cylindrical portion concentrically and integrally extending from said large disc portion and having a central quadrilateral bore extending therethrough and permitting said drive shaft to extend therethrough, a non-rotary wobble plate supported on said large disc portion and said small cylindrical portion of said drive plate, via thrust and radial bearings, respectively, so as to cause a compressing motion of said reciprocatory pistons, a dam formed in an outermost end face of said small cylindrical portion of said rotary drive plate as an integral lip-like raised portion defining an oil reservoir in an end portion of said quadrilateral bore of said small cylindrical portion at a position in proximity of said radial and thrust bearings for receiving and preserving lubricating oil therein during wobbling of said non-rotary wobble plate, an oil supply conduit extending from a bottom of said oil reservoir to said radial bearing for continuously lubricating said radial and thrust bearings, a guide means for permitting inclination of said wobble plate from a plane perpendicular to said drive shaft while preventing any rotation of said wobble plate about said drive shaft, and a control valve for controlling an angle of inclination of said wobble plate so as to vary a compressor discharge capacity in accordance with a refrigerating load.

2. A varible capacity wobble plate type compressor according to claim 1, wherein said oil reservoir is defined as a laterally extending channel in the quadrilateral bore of the small cylindrical portion.

3. A variable capacity wobble plate type compressor according to claim 1, wherein said oil conduit means has an oil entrance opening at a bottom portion of said oil reservoir and an oil exit opening at an outer circumference of said small cylindrical portion.

4. A variable capacity wobble plate type compressor according to claim 3, wherein said dam comprises a radially inward projection formed at an outer end of said small cylindrical portion of said drive plate.

* * * * *